US009351589B2

(12) United States Patent
Yeh et al.

(10) Patent No.: US 9,351,589 B2
(45) Date of Patent: May 31, 2016

(54) ELECTRONIC DEVICE ENCLOSURE WITH DOOR

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Chin-Wen Yeh, New Taipei (TW); Zhi-Jian Peng, Wuhan (CN); Yang Xiao, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 112 days.

(21) Appl. No.: 14/059,692

(22) Filed: Oct. 22, 2013

(65) Prior Publication Data

US 2014/0252933 A1 Sep. 11, 2014

(30) Foreign Application Priority Data

Mar. 11, 2013 (CN) ..... 2013 1 0076124

(51) Int. Cl.

| | |
|---|---|
| ***A47B 88/00*** | (2006.01) |
| ***A47F 3/00*** | (2006.01) |
| ***E05D 15/06*** | (2006.01) |

(52) U.S. Cl.

CPC ..... *A47F 3/00* (2013.01); *E05D 15/066* (2013.01); *E05Y 2900/608* (2013.01)

(58) Field of Classification Search

CPC ..... A47B 96/00; A47B 88/06; A47F 3/00; E05D 15/066; E05D 15/58; E05D 15/1065; E05D 15/582; E05D 15/581; E05D 2015/585; E05D 2015/586; E05D 2015/587; E05D 2015/588; E05D 7/081; H05K 7/00; E05Y 2900/202; E05Y 2900/20; E05Y 2201/21

USPC ..... 312/322

See application file for complete search history.

(56) References Cited

U.S. PATENT DOCUMENTS

| | | | | | |
|---|---|---|---|---|---|
| 289,311 | A | * | 11/1883 | Selby | 312/213 |
| 1,465,268 | A | * | 8/1923 | Holbrook | E05D 15/582 16/362 |
| 1,516,977 | A | * | 11/1924 | Moulton | 109/70 |
| 2,669,499 | A | * | 2/1954 | Vanderplank | 312/322 |
| 4,708,410 | A | * | 11/1987 | Mazaki | 312/138.1 |
| 6,007,171 | A | * | 12/1999 | Varellas-Olree | 312/323 |
| 2009/0126279 | A1 | * | 5/2009 | Kopish | 49/409 |
| 2012/0279130 | A1 | * | 11/2012 | Appeldoorn et al. | 49/252 |

FOREIGN PATENT DOCUMENTS

| | | | |
|---|---|---|---|
| EP | 1 449 999 | * | 2/2003 |

* cited by examiner

*Primary Examiner* — Daniel J Troy
*Assistant Examiner* — Timothy M Ayres
(74) *Attorney, Agent, or Firm* — Novak Druce Connolly Bove + Quigg LLP

(57) ABSTRACT

An electronic device enclosure includes a cabinet, a door movably mounted to the cabinet, and a limiting block rotatably mounted to the door. The cabinet includes a first side plate. The door defines a limiting slot. The door is movable relative to the cabinet between a closed position and an open position. When the door is located in the closed position, the door is substantially perpendicular to the first side plate and covers the cabinet. When the door is located in the open position, the door is substantially parallel to the first side plate, and the limiting block is engaged in the limiting slot, which prevents the door from dropping.

16 Claims, 8 Drawing Sheets

ELECTRONIC DEVICE ENCLOSURE WITH DOOR

BACKGROUND

1. Technical Field

The present disclosure relates to electronic device enclosures, and particularly to an electronic device enclosure with a door.

2. Description of Related Art

Vending machines typically includes an enclosure with a heavy door. Generally, a first side of the door is pivotably mounted to the main body of the enclosure and is rotatable to open or close according to the main body. However, when the door remains in an open state for a long time, a second side of the door may drop and cause interference with a base of the main body or other assemblies. Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
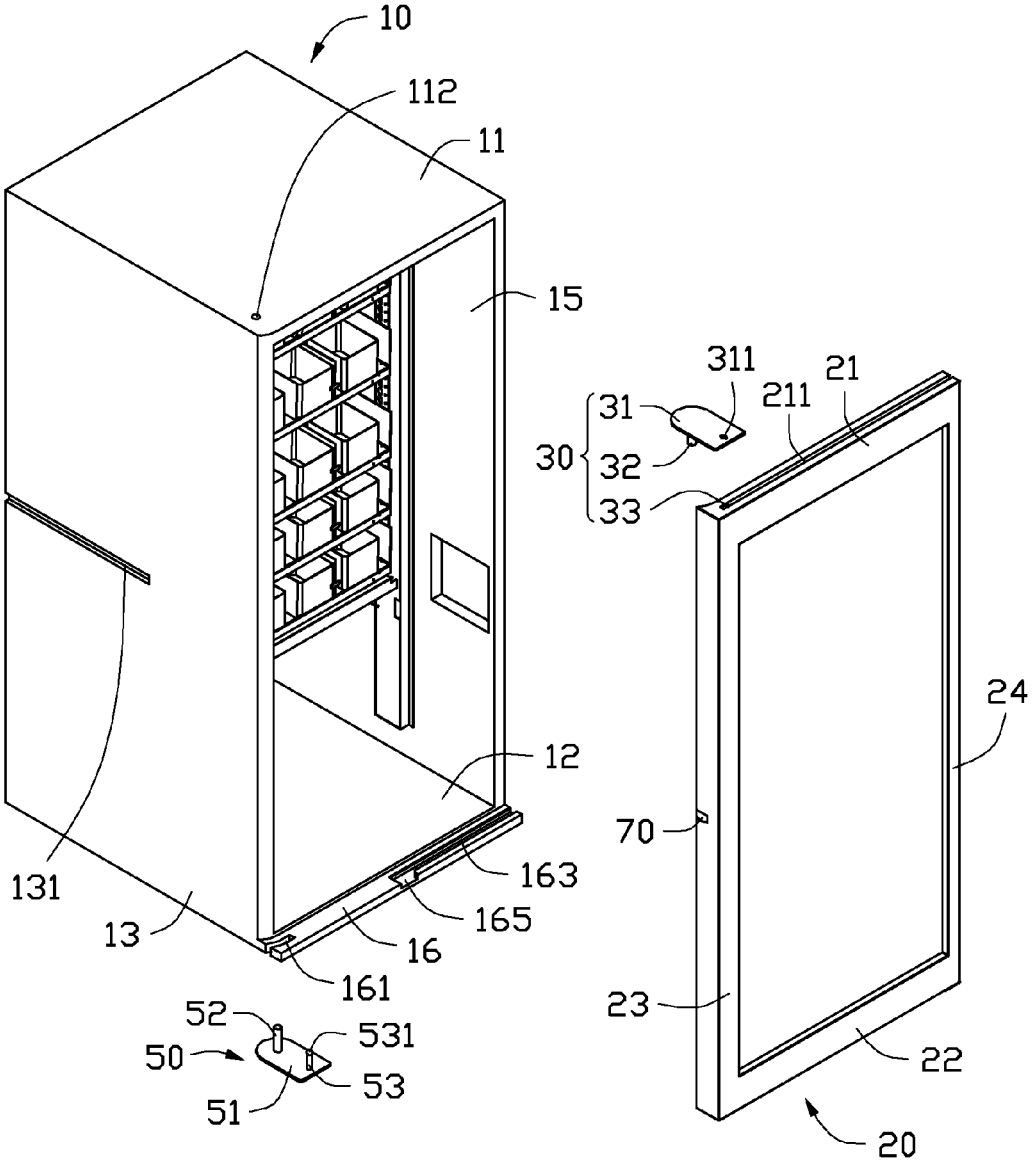
FIG. 1 is an exploded, isometric view of an embodiment of an electronic device enclosure.

FIG. 1 shows one embodiment of an electronic device enclosure. The electronic device enclosure includes a cabinet 10 and a door 20. The electronic device enclosure may be, a vending machine, for example.

The cabinet 10 includes a top plate 11, a bottom plate 12, a first side plate 13, and a second side plate 15 opposite to the first side plate 13. The top plate 11 is substantially parallel to the bottom plate 12, the first side plate 13 is substantially parallel to the second side plate 15, and the bottom plate 12 is substantially perpendicular to the first side plates 13.

The top plate 11 defines a first mounting hole 112 adjacent to the first side plate 13. The bottom plate 12 defines a second mounting hole (not shown) corresponding to the first mounting hole 112. An installation plate 16 extends outwards from an edge of the bottom plate 12. A first end of the installation plate 16, adjacent to the first side plate 13, defines a cutout 161. A second end of the installation plate 16, which is adjacent to the second side plate 15, defines a roller slot 163. The cutout 161 is curved. The roller slot 163 extends to a center of the installation plate 16. The installation plate 16 defines an exit port 165 communicating with the roller slot 163. An extending direction of the roller slot 163 is substantially perpendicular to the first side plate 13 and an extending direction of the exit port 165. The first side plate 13 defines a limiting slot 131 in a side edge of the first side plate 13 and is substantially parallel to the second side plate 15 and perpendicular to the bottom plate 12.

Figure 2:
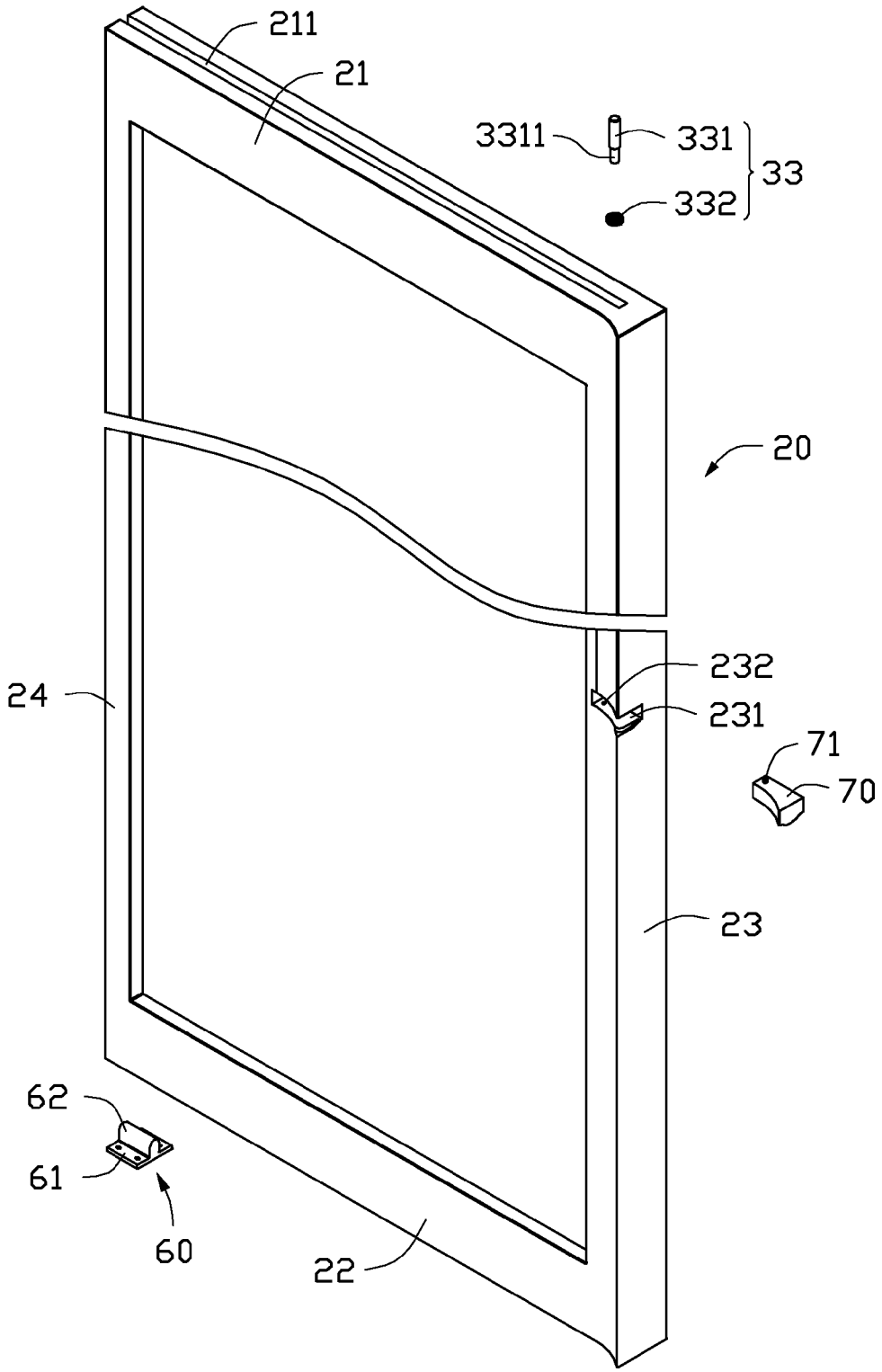
FIG. 2 is an exploded, isometric view of a door, a limiting block, a sliding member, and a roller module of the electronic device enclosure of FIG. 1.
Figure 3:
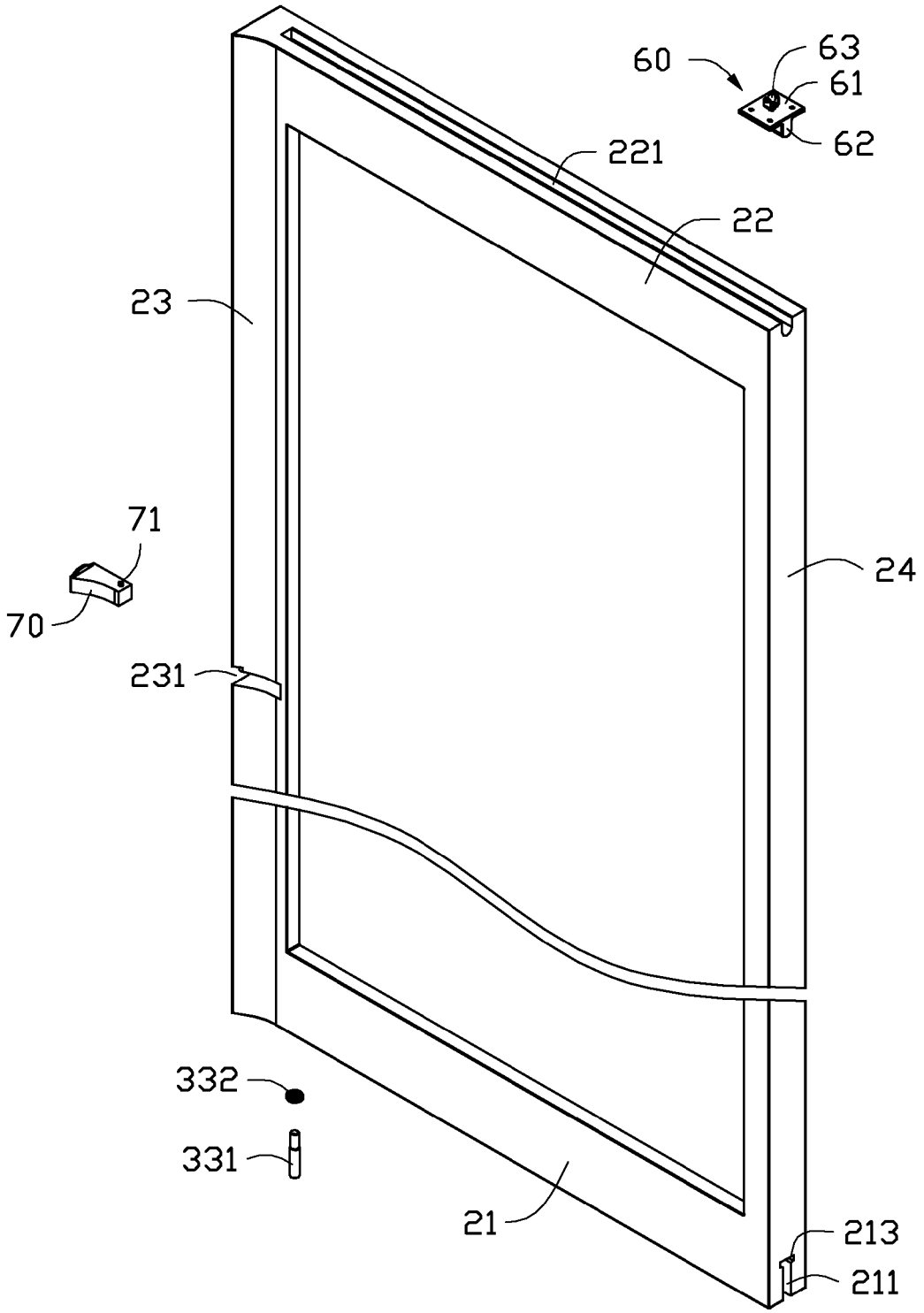
FIG. 3 is similar to FIG. 2 but viewed from a different aspect.

FIGS. 1-3 show that the door 20 includes a top frame 21, a bottom frame 22, a first side frame 23, and a second side frame 24. The top frame 21 is substantially parallel to the bottom frame 22, the first side frame 23 is substantially parallel to the second side frame 24, and the top frame 21 is substantially perpendicular to the first side frame 23. A top surface of the top frame 21 defines a top sliding slot 211 extending to the second side frame 24. The second side frame 24 defines a receiving slot 213 communicating with a distal end of the top sliding slot 211. A width of the receiving slot 213 is greater than a width of the top sliding slot 211. A bottom surface of the bottom frame 22 defines a bottom sliding slot 221. The first side frame 23 defines an installation slot 231. Two pivoting holes 232 are defined in opposite inner surfaces of the installation slot 231.

The electronic device enclosure further includes a mounting assembly movably mounting the door 20 to the cabinet 10. The mounting assembly includes a top sliding module 30, a bottom sliding module 50, a roller module 60, and a limiting block 70.

The top sliding module 30 includes a first rotating plate 31, a first pivoting shaft 32 extending from the first rotating plate 31, and a sliding member 33. The first rotating plate 31 defines a locking hole 311. The first pivoting shaft 32 is substantially perpendicular to the first rotating plate 31. The sliding member 33 includes a first sliding post 331 and a sliding washer 332. The first sliding post 331 includes an installation portion 3311. The sliding washer 332 can be secured to the installation portion 3311. In one embodiment, a cross-section of each of the sliding washer 332 and the first sliding post 331 is circular. A diameter of the sliding washer 332 is greater than a diameter of the first sliding post 331.

The bottom sliding assembly 50 includes a second rotating plate 51, a second pivoting shaft 52 extending from the second rotating plate 51, and a second sliding post 53. The second pivoting shaft 52 is substantially perpendicular to the second rotating plate 51. A protrusion 531 extends from a top end of the second sliding post 53.

The roller module 60 includes a mounting piece 61, a mounting block 62 extending from a first side of the mounting piece 61, and a roller 63 secured to a second side of the mounting piece 61. The roller 63 is rotatable relative to the mounting piece 61.

A shaft 71 extends from each of opposite sides of the limiting block 70. The shaft 71 corresponds to the pivoting hole 232.

Figure 4:
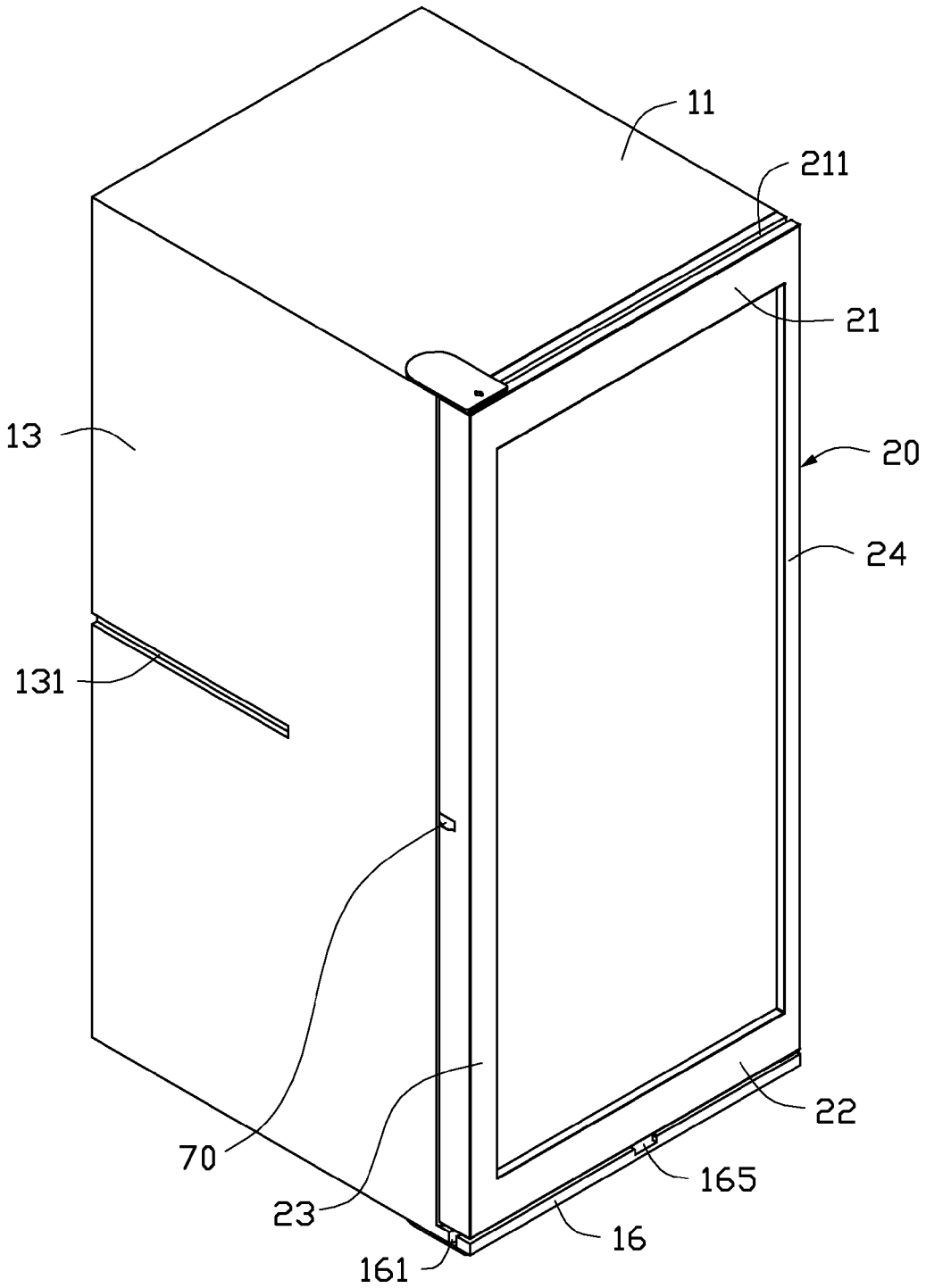
FIG. 4 is an assembled, isometric view of the electronic device enclosure of FIG. 1, showing the door in a closed position.
Figure 5:
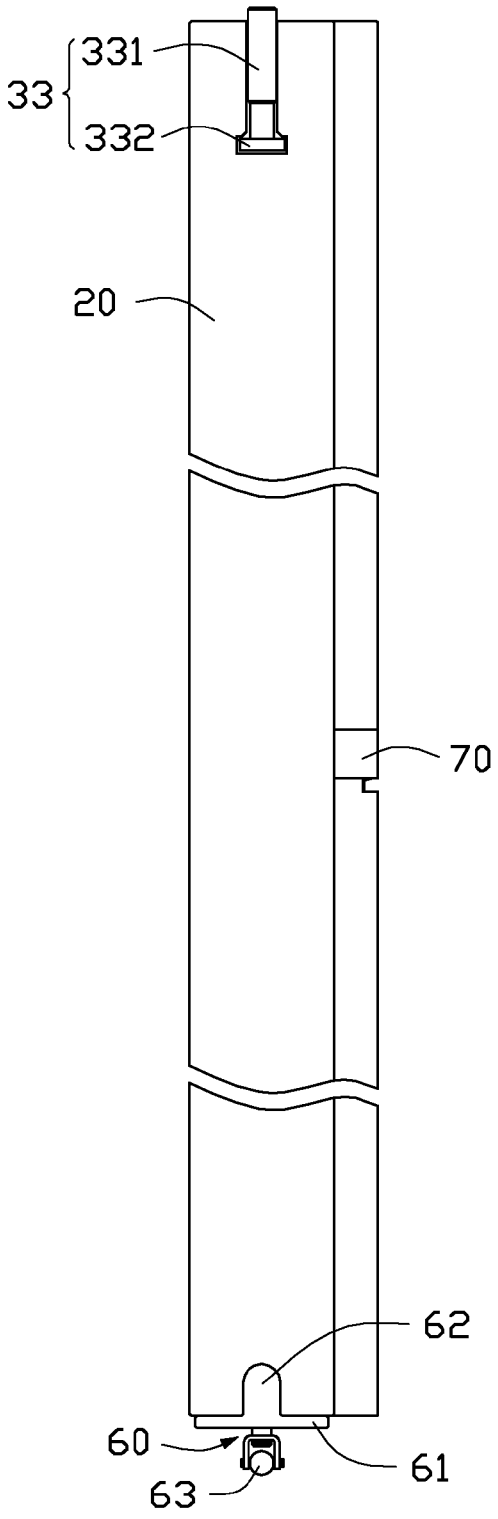
FIG. 5 is an assembled, isometric view of the door, the limiting block, the sliding member, and the roller module of FIG. 2.
Figure 6:
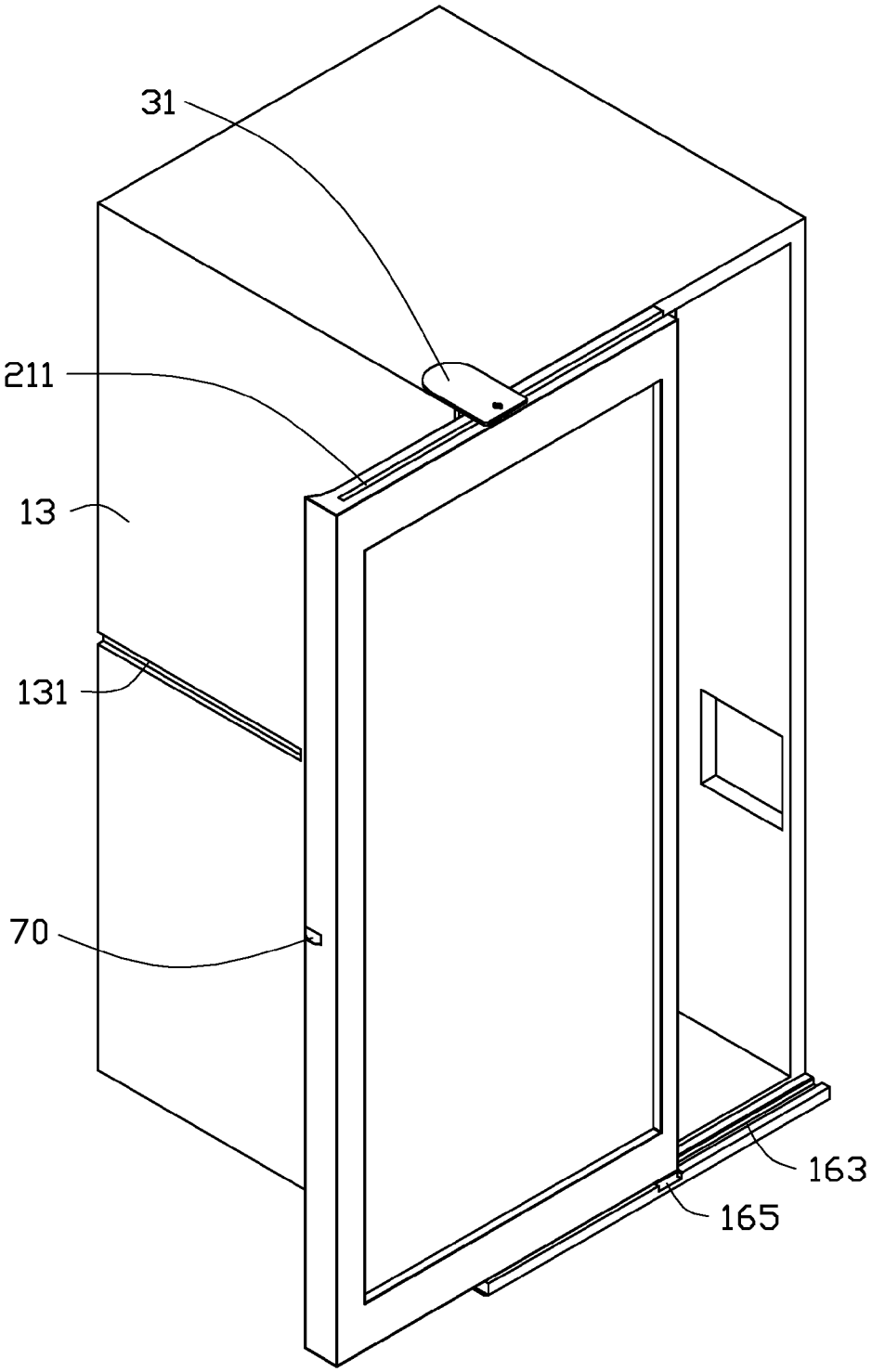
FIG. 6 is another assembled, isometric view of the electronic device enclosure of FIG. 1, showing the door in a first middle position.
Figure 7:
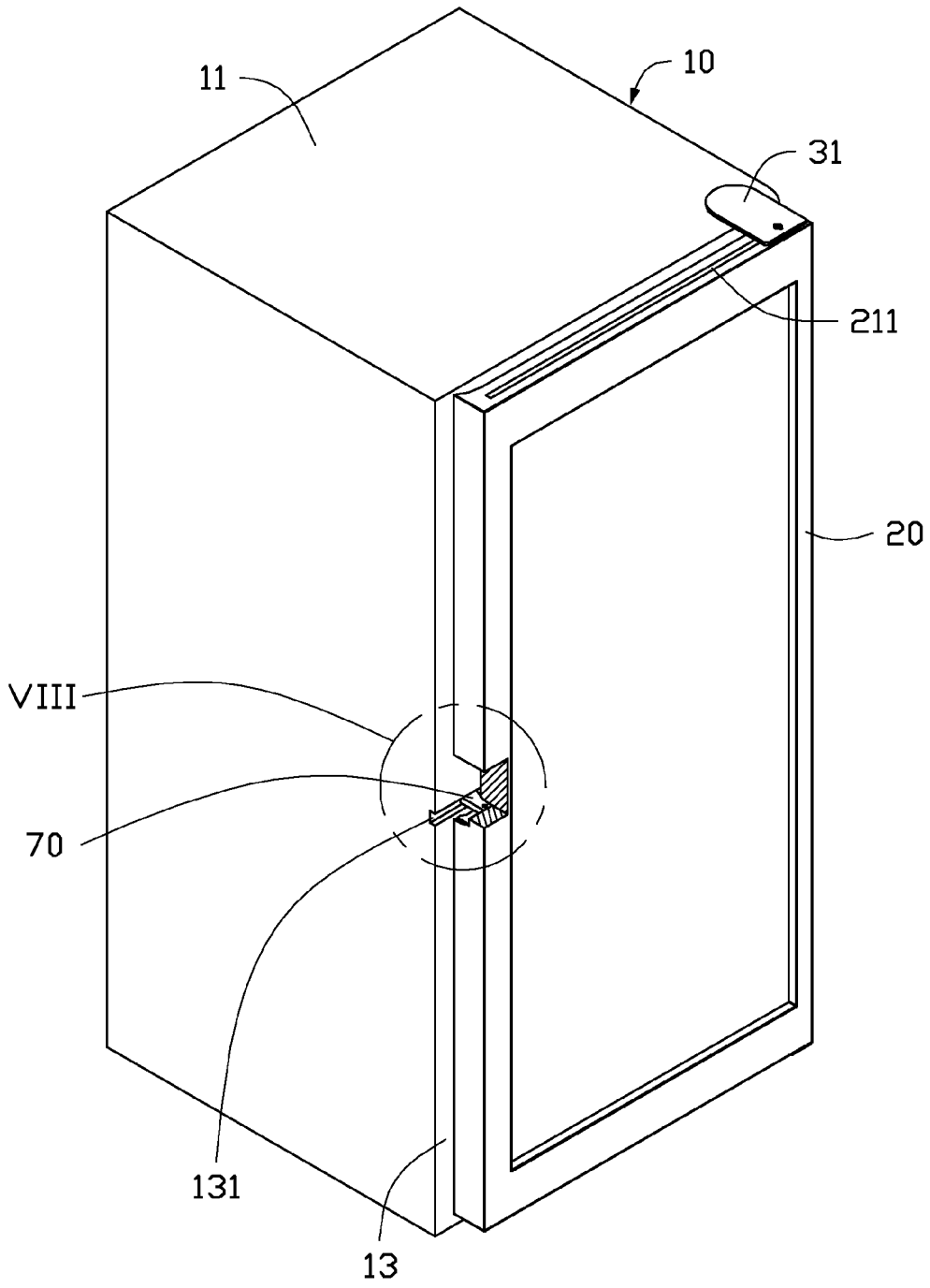
FIG. 7 is similar to FIG. 6, but showing the door in an open position.
Figure 8:
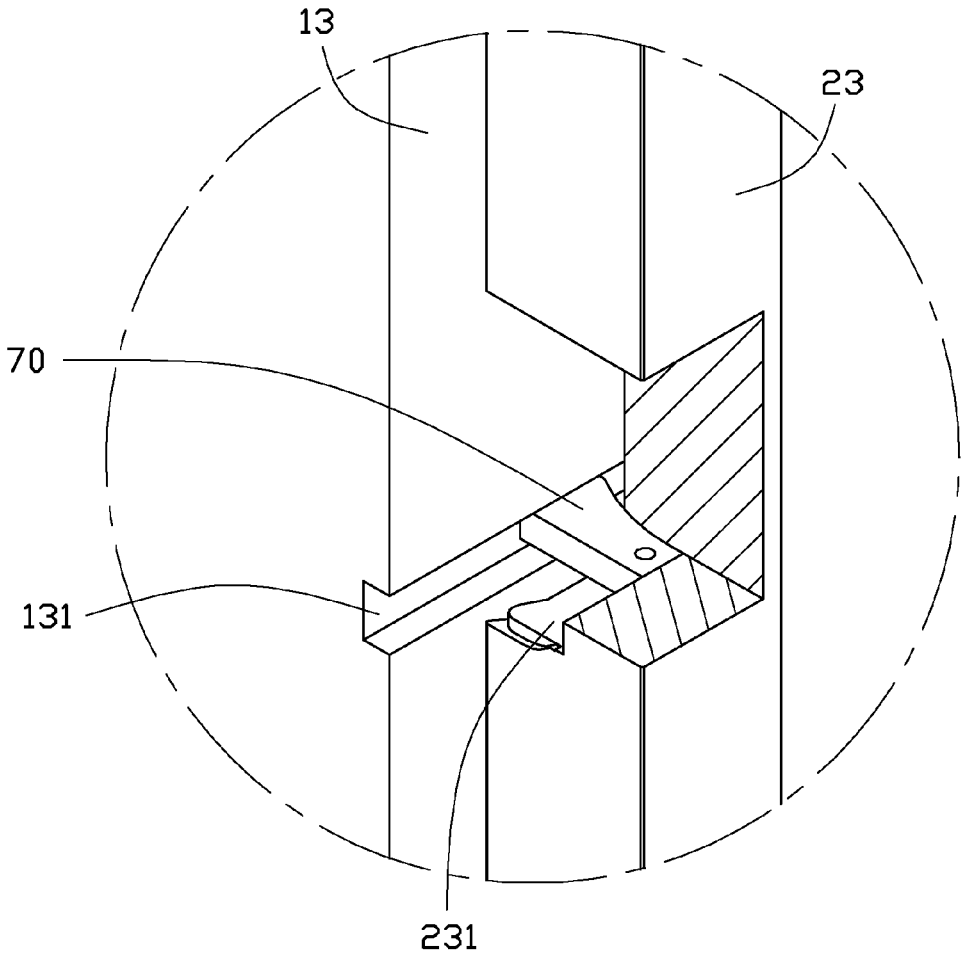
FIG. 8 is an enlarged view of a circled portion VIII of FIG. 7.

FIGS. 4 and 5 show that in assembly, the shaft 71 is engaged in the pivoting hole 232, to rotatably mount the limiting block 70 to the door 20. The mounting block 62 is engaged in the bottom sliding slot 221 and adjacent to the second side frame 24. The door 20 is moved towards the cabinet 10 until the roller 63 is in the roller slot 163. The second pivoting shaft 52 is rotatably engaged in the second mounting hole of the bottom plate 12, the second sliding post 53 extends through the cutout 161, and the protrusion 531 is located in the bottom sliding slot 221. The sliding washer 332 is secured to the installation portion 3311 and received in the receiving slot 213. The first sliding post 331 is slidably received in the top sliding slot 211 and partially extends out of the top sliding slot 211. The sliding washer 332 and the first sliding post 331 are slid until blocked by an end of the top sliding slot 211. The first pivoting shaft 32 is rotatably engaged in the first mounting hole 112, and the first sliding post 331 is engaged in the locking hole 311. Thus, the top sliding module 30 is rotatably mounted to the top plate 11, the bottom sliding module 50 is rotatably mounted to the bottom plate 12, and the mounting assembly movably mounts the door 20 to the cabinet 10.

FIGS. 4-8 show that the door 20 is movable relative to the cabinet 10 between a closed position and an open position. When the door 20 is in the closed position, the door 20 covers the cabinet 10 and is substantially perpendicular to the first side plate 13, the first sliding post 331 is located in a first end of the top sliding slot 211, the second sliding post 53 is located in a first end of the bottom sliding slot 221 and abuts the end of the cutout 161. When the door 20 is in the open position, the door 20 the cabinet 10 is open and the door 20 is located in a side of the first side plate 13 and substantially perpendicular to the first side plate 13. The first sliding post 331 is located in a second end of the top sliding slot 211, the second sliding post 53 is located in a second end of the bottom sliding slot 221, and the bottom sliding module 50 abuts the roller module 60 (shown in FIG. 7).

When the door 20 is moved from the closed position to the open position, the door 20 is slid until the roller module 60 is blocked by the roller slot 163. In this position, the first sliding post 331 is substantially located in a central of the top sliding slot 211, the second sliding post 53 is substantially located in a central of the bottom sliding slot 221, and the roller 63 is aligned with the exit port 165. The door 20 is located in a first middle position and hold by the installation plate 16 (shown in FIG. 6), and the door 20 is prevented from sinking down.

The door 20 is rotated towards the first side plate 13, the roller 63 is slid out of the exit port 165. The door 20 rotates the first rotating plate 31 towards the first side plate 13 by the first sliding post 331 and the sliding washer 332. At the same time, the door 20 rotates the second rotating plate 51 towards the first side plate 13 by the second sliding post 53. The second sliding post 53 is slid in the cutout 161. When the door 20 is substantially parallel to the first side plate 13, each of the first rotating plate 31 and the second rotating plate 53 is rotated substantially 90 degrees. In this position, the limiting block 70 is aligned with the limiting slot 131, the second sliding post 53 slides out of the cutout 161. The door 20 is located in a second middle position.

The limiting block 70 is pulled to partially rotate in the limiting slot 131. The door 20 is slid along a direction substantially parallel to the first side plate 13, until the bottom module 50 is blocked by the roller module 60. In this position, the door 20 is located in the open position and is held by the first side plate 13 through the limiting block 70, which prevents the door 20 from dropping.

When the door 20 is moved from the open position to the closed position, the door 20 is slid to the second middle position, until the limiting block 70 is slid to an end of the limiting slot 131. The door 20 is rotated away from the first side plate 13, the roller 63 is slid into the exit port 165, and the second sliding post 53 is slid in the cutout 161. Thus, the door 20 is rotated to the first middle position. The door 20 is slid until covering the cabinet 10.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and the arrangement of parts within the principles of the disclosure, to the full extent indicated by the broad general meaning of the terms in which the appended claims are expressed.

What is claimed is:

1. An electronic device enclosure, comprising:

a cabinet comprising a top plate, a bottom plate, and a first side plate;

a door mounted to the cabinet and comprising a top frame and a bottom frame opposite to the top frame;

a top sliding module rotatably mounted to the top plate;

a bottom sliding module rotatably mounted to the bottom plate; and a limiting block mounted to the door;

wherein the first side plate defines a limiting slot, the door defines an installation slot, and the limiting block is received in the installation slot and is rotatable relative to the door to extend out of the installation slot; the top frame is rotatably mounted to the top sliding module; the bottom frame is rotatably mounted to the bottom sliding module; the door is movable relative to the cabinet between a closed position and an open position; when the door is in the closed position, the top sliding module is at a first end of the top frame, the bottom sliding module is at a first end of the bottom frame, the door is substantially perpendicular to the first side plate and is slidable relative to the cabinet along a first direction; and when the door is in the open position, the top sliding module is at a second end of the top frame, the bottom sliding module is at a second end of the bottom frame, the door is substantially parallel to the first side plate and is slidable relative to the cabinet along a second direction, and the limiting block is engaged in the limiting slot;

wherein the bottom sliding module comprises a bottom sliding post and a protrusion extending from the bottom sliding post; the bottom frame defines a bottom sliding slot; and each of the bottom sliding post and the protrusion is slidably received in the bottom sliding slot; and wherein the cabinet further comprises an installation plate extending from the bottom plate, and the installation plate defines a cutout; when the door is located in the closed position, the bottom sliding post is received in the bottom sliding slot through the cutout and when the door is in the open position, the bottom sliding post is disengaged from the cutout.

2. The electronic device enclosure of claim 1, wherein the top frame defines a top sliding slot and a receiving slot communicating with the top sliding slot; the top sliding module comprises a top sliding post and a sliding washer secured to the top sliding post; the top sliding post is slidably engaged in the top sliding slot; the sliding washer is slidably engaged in the receiving slot; and a width of the receiving slot is greater than a width of the top sliding slot.

3. The electronic device enclosure of claim 1, wherein the cutout is curved.

4. The electronic device enclosure of claim 1, wherein the cabinet further comprises a roller module, the roller module comprises a roller, and the installation plate further defines a roller slot for the roller sliding along.

5. The electronic device enclosure of claim 4, wherein the installation plate further defines an exit port communicating with the roller slot, an extending direction of the exit port is substantially perpendicular to an extending direction of the roller slot, and the roller is slidable out of the exit port or capable of being slid in the roller slot through the exit port.

6. The electronic device enclosure of claim 5, wherein the door is slidable relative to the cabinet between the closed position and a first middle position along the first direction; when the door is in the closed position, the bottom sliding module abuts an end of the cutout; and when the door is in the first middle position, the roller module abuts the end of the cutout, and the roller is aligned with the exit port.

7. The electronic device enclosure of claim 6, wherein the door is slidable relative to the cabinet between the open position and a second middle position along the second direction; when the door is in the open position, the bottom sliding module abuts the roller module; and when the door is in the second middle position, the limiting block abuts an end of the limiting slot, and the roller module and the limiting slot prevent the door from sliding out of the cabinet.

8. The electronic device enclosure of claim 7, wherein the door is rotatable relative to the cabinet between the first middle position and the second middle position, when the door is rotated, the door rotates the top sliding module and the bottom sliding module, the second sliding post is slid in or out of the cutout, and the roller is slid in or out of the exit port.

9. An electronic device enclosure, comprising:

a cabinet comprising a top plate, a bottom plate, and a first side plate;

a door mounted to the cabinet and comprising a top frame and a bottom frame opposite to the top frame;

a top sliding module rotatably mounted to the top plate;

a bottom sliding module rotatably mounted to the bottom plate; and a limiting block rotatably mounted to the door;

wherein the first side plate defines a limiting slot, the door defines an installation slot, and the limiting block is received in the installation slot and is rotatable relative to the door to extend out of the installation slot; the top frame is rotatably mounted to the top sliding module; the bottom frame is rotatably mounted to the bottom sliding module; the door is slidable relative to the cabinet between a closed position and a first middle position; when the door is in the closed position, the top sliding module is at a first end of the top frame, the bottom sliding module is at a first end of the bottom frame, and the door is substantially perpendicular to the first side plate and is slidable relative to the cabinet along a first direction; and when the door is in the first middle position, the door partially opens the cabinet and is substantially perpendicular to the first side plate; the door is rotatable relative to the cabinet between the first middle position to a second middle position, when the door is in the second middle position, the top sliding module is at a central portion of the top frame, the bottom sliding module is at a central portion of the bottom frame, and the door is substantially parallel to the first side plate; and the door is further slidable relative to the cabinet between the second middle portion and an open position, and when the door is in the open position, the top sliding module is sat a second end of the top frame, the bottom sliding module is at a second end of the bottom frame, the door is substantially parallel to the first side plate and is slidable relative to the cabinet along a second direction, and the limiting block is partially engaged in the limiting slot;

wherein the bottom sliding module comprises a bottom sliding post and a protrusion extending from the bottom sliding post; the bottom frame defines a bottom sliding slot and each of the bottom sliding post and the protrusion is slidably received in the bottom sliding slot; and wherein the cabinet further comprises an installation plate extending from the bottom plate, and the installation plate defines a cutout; when the door is located in the closed position, the bottom sliding post is received in the bottom sliding slot through the cutout and when the door is in the open position, the bottom sliding post is disengaged from the cutout.

10. The electronic device enclosure of claim 9, wherein the top frame defines a top sliding slot and a receiving slot communicating with the top sliding slot; the top sliding module comprises a top sliding post and a sliding washer secured to the top sliding post; the top sliding post is slidably engaged in the top sliding slot; the sliding washer is slidably engaged in the receiving slot; and a width of the receiving slot is greater than a width of the top sliding slot.

11. The electronic device enclosure of claim 9, wherein the cutout is curved.

12. The electronic device enclosure of claim 9, wherein the cabinet further comprises a roller module, the roller module comprises a roller, and the installation plate further defines a roller slot for the roller sliding along.

13. The electronic device enclosure of claim 12, wherein the installation plate further defines an exit port communicating with the roller slot, an extending direction of the exit port is substantially perpendicular to an extending direction of the roller slot, and the roller is slidable out of the exit port or capable of being slid in the roller slot through the exit port.

14. The electronic device enclosure of claim 13, wherein when the door is in the closed position, the bottom sliding module abuts an end of the cutout; and when the door is in the first middle position, the roller module abuts the end of the cutout, and the roller is aligned with the exit port.

15. The electronic device enclosure of claim 13, wherein when the door is in the open position, the bottom sliding module abuts the roller module; and when the door is in the second middle position, the limiting block abuts an end of the limiting slot, and the roller module and the limiting slot prevent the door from sliding out of the cabinet.

16. The electronic device enclosure of claim 15, wherein the door is rotatable relative to the cabinet between the first middle position and the second middle position, when the door is rotated, the door rotates the top sliding module and the bottom sliding module, the second sliding post is slid in or out of the cutout, and the roller is slid in or out of the exit port.

* * * * *